United States Patent [19]

Shiroki et al.

[11] Patent Number: 4,605,484

[45] Date of Patent: Aug. 12, 1986

[54] HYDROGEN-EVOLUTION ELECTRODE

[75] Inventors: Hiroyuki Shiroki; Yasuhide Noaki, both of Miyazaki, Japan

[73] Assignee: Asahi Kasei Kogyo Kabushiki Kaisha, Osaka, Japan

[21] Appl. No.: 731,598

[22] Filed: May 6, 1985

Related U.S. Application Data

[63] Continuation of Ser. No. 549,755, Nov. 8, 1983, abandoned.

[30] Foreign Application Priority Data

Nov. 30, 1982 [JP] Japan ..... 57-208653
Mar. 8, 1983 [JP] Japan ..... 58-36620

[51] Int. Cl.[4] ..... C25B 11/00

[52] U.S. Cl. ..... 204/290 R; 427/34; 427/124; 427/126.6

[58] Field of Search ..... 204/290 R; 427/123, 427/124, 126.6, 423, 34

[56] References Cited

U.S. PATENT DOCUMENTS 3,992,278 11/1976 Malkin et al. ..... 204/242
4,024,044 5/1977 Brannan et al. ..... 204/242
4,033,837 7/1977 Kuo et al. ..... 204/98
4,049,841 9/1977 Coker ..... 204/290 R
4,080,278 3/1978 Ravier et al. ..... 204/242
4,243,497 1/1981 Nicolas et al. ..... 204/98
4,410,413 10/1983 Hall ..... 204/290 R
4,422,920 12/1983 Stachurski ..... 204/290 R

*Primary Examiner*—John F. Niebling
*Attorney, Agent, or Firm*—Birch, Stewart, Kolasch & Birch

[57] ABSTRACT

An improved hydrogen-evolution electrode having thereon a coating containing an oxide of at least one metal selected from nickel and cobalt and further containing a chromium component in a proportion, in terms of atomic percentage, of 0.5 to 20% has been found to exhibit extremely low hydrogen overvoltage and to have not only high catalytic activity but also high durability. Such a hydrogen-evolution electrode can be produced by melt-spraying onto a substrate a mixture of a powder of at least one member selected from the first group consisting of nickel, cobalt, oxides of nickel and cobalt, hydroxides of nickel and cobalt, organic acid salts of nickel and cobalt and inorganic acid salts of nickel and cobalt and a powder of at least one member selected from the second group consisting of chromium, an oxide of chromium, a hydroxide of chromium, an organic acid salt of chromium and an inorganic acid salt of chromium. In the production, when the above-mentioned mixture is subjected to granulation and the obtained granules are melt-sprayed, there can be obtained the desired electrode having excellent properties with respect to catalytic activity and durability in high spraying yield.

7 Claims, 5 Drawing Figures

FIG. 1-(1)
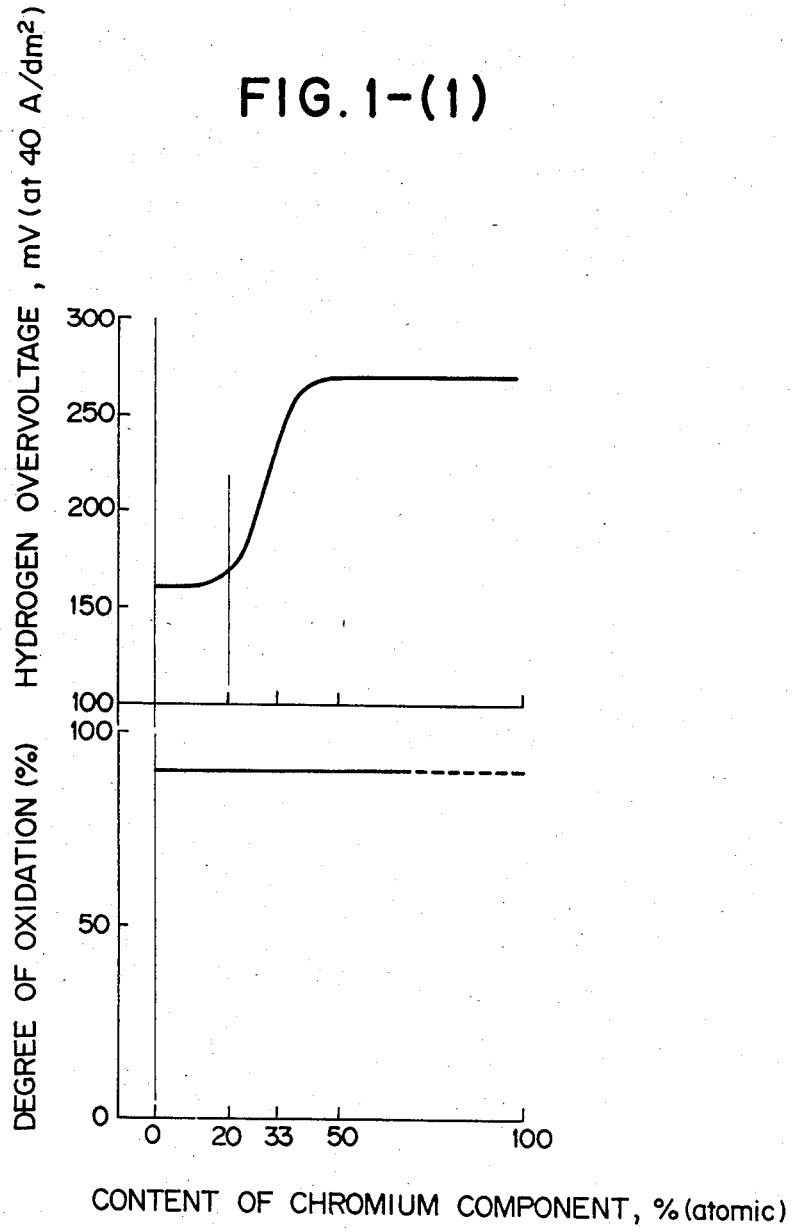

FIG. 1-(2)
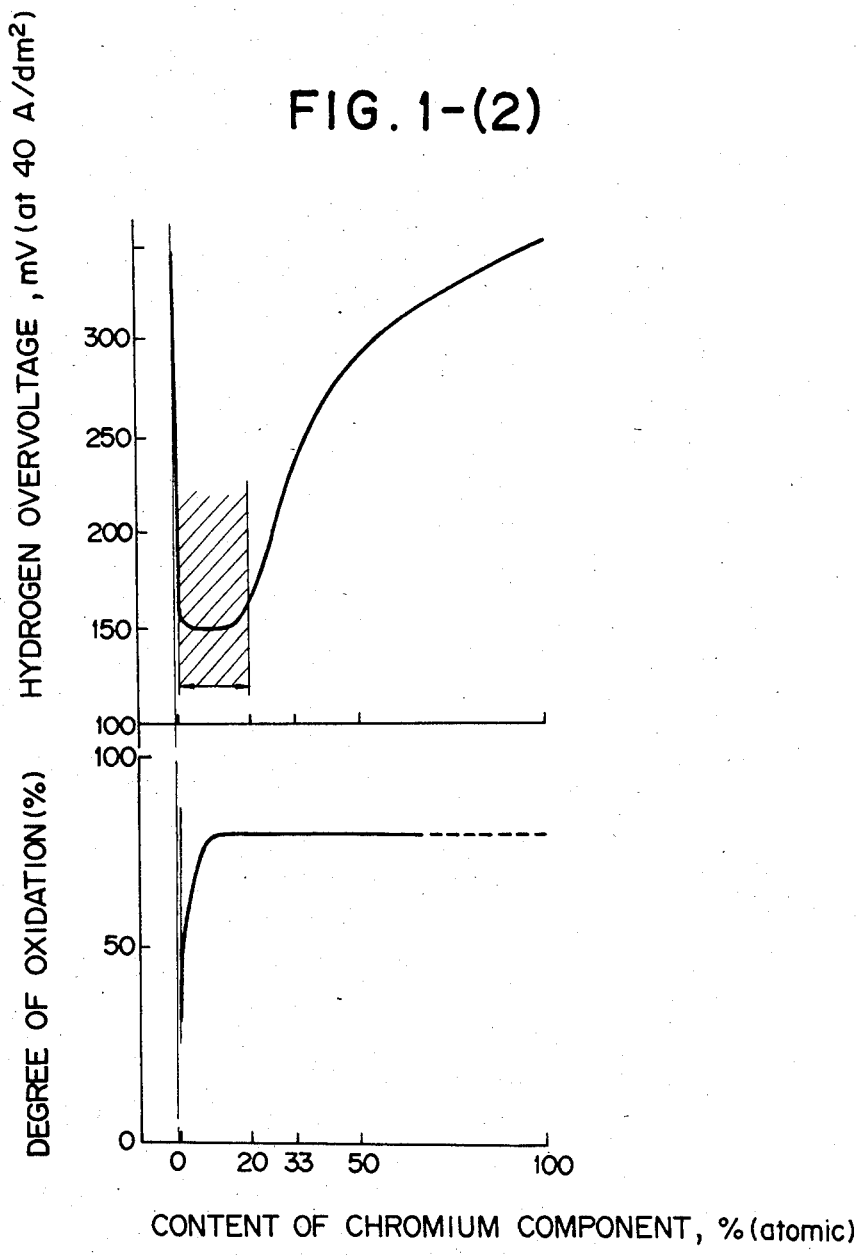

HYDROGEN-EVOLUTION ELECTRODE

This application is a continuation of application Ser. No. 549,755 filed on Nov. 8, 1983, now abandoned.

BACKGROUND AND SUMMARY OF THE INVENTION

The present invention relates to a hydrogen-evolution electrode which not only exhibits low hydrogen overvoltage and high stability for a long period of time but also is available at low cost, and a method for producing the same. More particularly, the present invention is directed to a hydrogen-evolution electrode which comprises an electrically conductive substrate having thereon a coating layer containing a chromium component and an oxide of at least one metal selected from the group consisting of nickel and cobalt, wherein the content of chromium in the coating layer is 0.5 to 20% in terms of atomic percentage as defined later, and a method for producing the same.

Recently, due to the rapid increase in cost of energy, it has become very important more and more to decrease the superfluous consumption of energy by lowering the hydrogen overvoltage of a hydrogen-evolution electrode used in industrial electrolysis. For this purpose, many researches and developments have been made. For example, in order to decrease the hydrogen overvoltage of a hydrogen-evolution electrode, it has been attempted to increase the surface area of the electrode or to incorporate an electrode catalyst into the electrode, by means of a technique such as an electroplating method, a chemical plating method, a method comprising applying a coating solution followed by baking and melt-spraying. Further, as the technique to increase the surface area of the electrode or to incorporate an electode catalyst into the electrode, there have been proposed a method comprising melt-spraying onto a substrate a powder material containing a sacrificial metal component followed by leaching out of the sacrificial metal component, a method comprising applying a coating solution onto a substrate followed by baking and heating the obtained coating in a reducing atmosphere and the like. There have been proposed, as the electrode catalyst capable of lowering the hydrogen overvoltage, transition metals such as cobalt, molybdenum, vanadium, manganese and tungusten, noble metals such as platinum, silver, ruthenium and iridium or a mixture thereof, or a combination of a metal component selected from the above metals with a sacrificial metal component. The heretofore proposed electrodes include those in which a metal, an alloy or a mixture thereof is used as an active material, and those in which a metal oxide, a compound oxide or a mixture of metal oxides is used as an active material.

As examples of the electrode in which a metal, an alloy or a mixture thereof is used as an active material, there can be mentioned an electrode which comprises a copper substrate bearing on its surface a coating of an alloy of nickel, vanadium and molybdenum formed by plating (U.S. Pat. No. 4,033,837); an electrode having a coating of an alloy of cobalt, molybdenum and vanadium formed by electroplating (Japanese Patent Application Laid-Open Specification No. 33490/1981); an electrode coated with a thin nickel layer containing manganese and sulfur (Japanese Patent Application Publication No. 6715/1980); an electrode which comprises an alloy of a metal selected from nickel and cobalt and a metal selected from titanium and magnesium (Japanese Patent Application Publication No. 44955/1981); an electrode which is produced by a method which comprises applying a homogeneous solution containing a metal selected from the first group consisting of iron, cobalt, nickel and manganese and a metal selected from the second group consisting of molybdenum, vanadium and tungsten, followed by baking to obtain a coating of a mixture of oxides, and heating the obtained coating in a reducing atmosphere to cure it (European Patent Application Laid-Open Specification No. 9406); an electrode prepared by a process which comprises applying onto a substrate a mixture of an alloy of iron or a metallic component composed mainly of iron and an alkali-soluble sacrificial metal by melt-spraying, and subsequently leaching out the sacrificial metal by an alkali-treatment (Japanese Patent Application Laid-Open Specification No. 115984/1980); an electrode prepared by a process which comprises applying onto a substrate a Raney type alloy containing a sacrificial metal by melt-spraying to form a coating, followed by leaching out the sacrificial metal in the melt-sprayed coating by means of alkali-treatment and anodic polarization, and subsequently plating its surface with a metal which exhibits low hydrogen overvoltage (Japanese Patent Application Laid-Open Specification No. 122887/1980); an electrode prepared by a process which comprises applying onto a substrate a mixture of nickel and a water-soluble compound capable of being melt-sprayed by melt-spraying to form a coating and leaching out the compound to form a porous nickel coating (Japanese Patent Application Laid-Open Specification No. 188689/1982); an electrode bearing on its surface a coating prepared by melt-spraying a powder material exhibiting low hydrogen overvoltage, said powder material being a powder of metal selected from the group consisting of cobalt, nickel, platinum, molybdenum, tungsten, manganese, iron, tantalum and niobium, a carbide thereof, a nitride thereof, an aluminide thereof and an alloy thereof, and a mixture thereof (U.S. Pat. No. 4,049,841); and an electrode prepared by a process which comprises applying onto a substrate a mixture of particulate nickel, particulate cobalt and particulate aluminum by melt-spraying to form a coating and removing aluminum from the melt-sprayed coating by leaching (U.S. Pat. No. 4,024,044).

The above-mentioned electrodes in which a metal, an alloy or a mixture thereof is used as an active material have a fatal disadvantage that when electrolysis is continuously effected using the above-mentioned type of electrode as a hydrogen-evolution electrode, the hydrogen overvoltage of the electrode increases with the lapse of time, and the activity of the electrode is lost. Moreover, the electrode of the above type has another disadvantage that, in the electrolysis of a sodium chloride solution according to the ion exchange membrane method using the above-mentioned type of electrode, a metal component of the electrode dissolves out of the electrode by corrosion or the electrode comes into a passive state by oxidation due to the reverse current which occurs at the time of stopping of the electrolysis, whereby the life of the electrode becomes short.

As electrodes eliminating the above-mentioned disadvantages of the electrode of which the active material is a metal or the like, there have been proposed electrodes in which a metal oxide, a compound oxide or a mixture of metal oxides is used as an active material. As examples of the electrodes of the above-mentioned kind, there can be mentioned an electrode of which surface consists essentially of a spinel type compound oxide to be used in producing hydrogen by electrolysis, in which said compound oxide is represented by the general formula $(M_{II})(M_{III})_2O_4$ wherein $(M_{II})$ is selected from the group consisting of iron, zinc, manganese, nickel, cobalt, magnesium, cadmium and copper and $(M_{III})$ is selected from the group consisting of iron, chromium, manganese, nickel and cobalt and wherein, necessarily, the proportions of $M_{II}$ and $M_{III}$ to $M_{II}+M_{III}$, in terms of atomic percentage, are about 33% and about 67%, respectively (U.S. Pat. No. 4,243,497); and an electrode which comprises a titanium-containing non-stoichiometric compound bonded by a metal selected from nickel, cobalt and iron, wherein said titanium-containing non-stoichiometric compound further comprises a compound represented by the formula $A_xTi_yO_z$ (in which A is an alkali metal) (U.S. Pat. No. 4,080,278). However, such electrodes in which a compound oxide is used as an active material cannot exhibit sufficiently low hydrogen overvoltage. In European Patent Application Laid-Open Specification No. 23368, there is disclosed an electrode which contains a metal oxide prepared by thermally decomposing a thermally decomposable compound of cobalt, iron, manganese or nickel. Such an electrode cannot exhibit sufficiently low hydrogen overvoltage, or the metal oxide of the above-mentioned electrode is reduced to the state of metal by a hydrogen-evolution reaction in a relatively short period of time. The electrode containing the thus reduced metal oxide, similarly to an electrode of which the active material is a metal or the like, has not only such a disadvantage that the hydrogen overvoltage increases in an electrolysis involving a hydrogen-evolution reaction with the lapse of time but also such a disadvantage that the activity of the electrode is lost due to dissolution-out of a metal component caused by reverse current.

Moreover, there has been proposed an electrode having on its surface a coating of a melt-sprayed admixture consisting essentially of particulate cobalt and particulate zirconia (U.S. Pat. No. 3,992,278). Although this electrode comprises a coating of a combination of a metal with a metal oxide, this electrode also cannot exhibit sufficiently low hydrogen overvoltage and therefore, this electrode is also not suitable for use as a hydrogen-evolution electrode. Moreover, the hydrogen-evolution potential of the above-mentioned electrode during the electrolysis is less noble than the electrodeposition potential of iron ions which are dissolved in an electrolyte in a small amount. For this reason, the iron ions are consecutively electrodeposited onto the electrode, so that the effectiveness of the coating of the above-mentioned kind of electrode is lost in a short period of time.

With respect to an industrially useful hydrogen-evolution electrode, it is essentially required that not only the hydrogen overvoltage be sufficiently low but also the activity of the electrode be maintained for a sufficiently long period of time and that the cost of the electrode be low as compared with the profit derived from the electrode. As mentioned above, however, there has not ever been proposed an electrode which satisfies the above-mentioned requirements, especially the requirement as to the life of the electrode.

With a view to developing a practically useful and economical hydrogen-evolution electrode which not only exhibits low hydrogen overvoltage but also has high durability, the present inventors have made extensive and intensive researches. First, the present inventors' attention was directed to metal oxides which form active sites of a hydrogen-evolution electrode. As examples of the metal oxides forming active sites of the electrode, there may be mentioned oxides of metals such as iron, cobalt, nickel, manganese, chromium, molybdenum, tungusten, vanadium, niobium, tantalum, titanium, zirconium, copper, silver, gold, zinc, cadmium, aluminum, gallium, tin, ruthenium, rhodium, palladium osmium, iridium and platinum and the like. Of them, oxides of nickel and cobalt are preferable from the standpoints of high catalytic activity, stability in an electrolyte and availability as an industrial material. In other words, a hydrogen-evolution electrode having a coating of nickel oxide and/or cobalt oxide is advantageous from the standpoints of high catalytic activity, stability in an electrolyte and availability. However, when such electrode is continuously used in an electrolysis involving a hydrogen-evolution reaction over more than one year, the activity of the electrode tends to be decreased. In order to elucidate the cause of decrease of the activity, the present inventors have made an investigation on the decrease of activity of such electrode. As a result, it has been found that the degree of oxidation of the coating (which will be explained later) is remarkably decreased after a long period of electrolysis. Further, it has been found that when the degree of oxidation of the electrode coating is less than 30%, the hydrogen overvoltage which the electrode exhibits tends to considerably increase with the lapse of time. In order to prevent the decrease of the degree of oxidation of the electrode coating, the present inventors have further made extensive and intensive researches. As a result, it has been found that when at least one member selected from the group consisting of chromium, vanadium, titanium, manganese and niobium and compounds thereof is incorporated into the electrode coating containing an oxide capable of forming active sites, the reduction of the oxide in the coating can be prevented, that is, the decrease of the degree of oxidation of the coating can be prevented. Still further, the present inventors have made an investigation on the influence of the above-mentioned materials on the activity and chemical and electrochemical stability of the electrode. As a result, it has been found that chromium and titanium and compounds thereof are preferable and that chromium and compounds thereof are more preferable. Chromium and compounds thereof are excellent in preventing the decrease of the electrode activity as compared with titanium and compounds thereof.

Based on the above findings, the present inventors have still further made intensive researches with a view to developing a hydrogen-evolution electrode which not only exhibits low hydrogen overvoltage but also has high durability. As a result, it has been found that when the coating of an electrode contains an oxide of at least one metal selected from nickel and cobalt and further contains a chromium component (which will be mentioned later) in a proportion, in terms of atomic percentage, of 0.5 to 20%, the electrode not only exhibits extremely low hydrogen overvoltage but also has high durability.

The present invention has been made based on the above novel findings.

Accordingly, it is one object of the present invention to provide a hydrogen-evolution electrode which not only exhibits low hydrogen overvoltage but also has high durability.

It is another object of the present invention to provide a method of producing a hydrogen-evolution electrode of the kind described above, which can be practiced with ease and high productivity.

BRIEF DESCRIPTION OF THE DRAWINGS

The foregoing and other objects, features and advantages of the present invention will be apparent to those skilled in in the art from the following detailed description taken in connection with the accompanying drawings in which:

FIG. 1-(1) is a graph showing the relationship between the content of chromium component, hydrogen overvoltage and degree of oxidation in a nickel oxide-chromium type coating electrode at the initial stage of electrolysis;

FIG. 1-(2) is a graph showing the relationship between the content of chromium component, hydrogen overvoltage and degree of oxidation in a nickel oxide-chromium type coating electrode after the 10-month operation of electrolysis;

Figure 3:
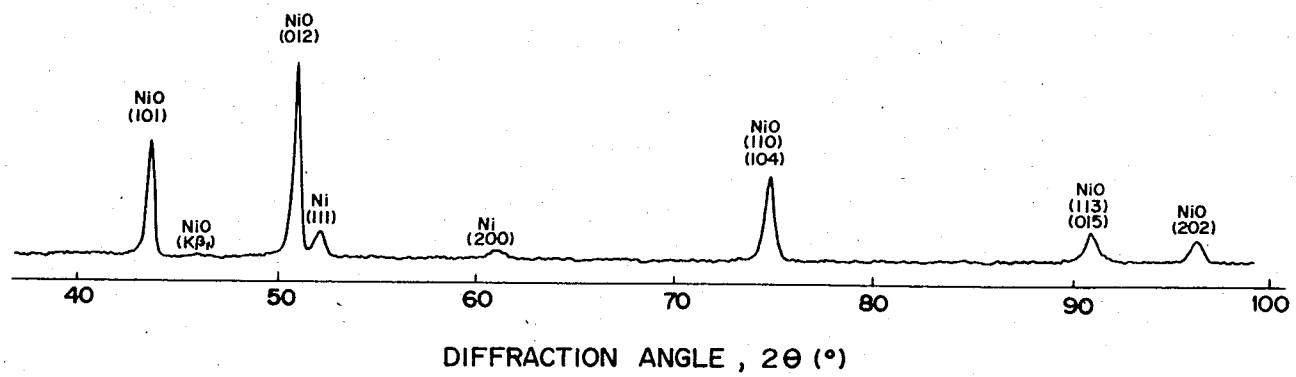
Figure 4:
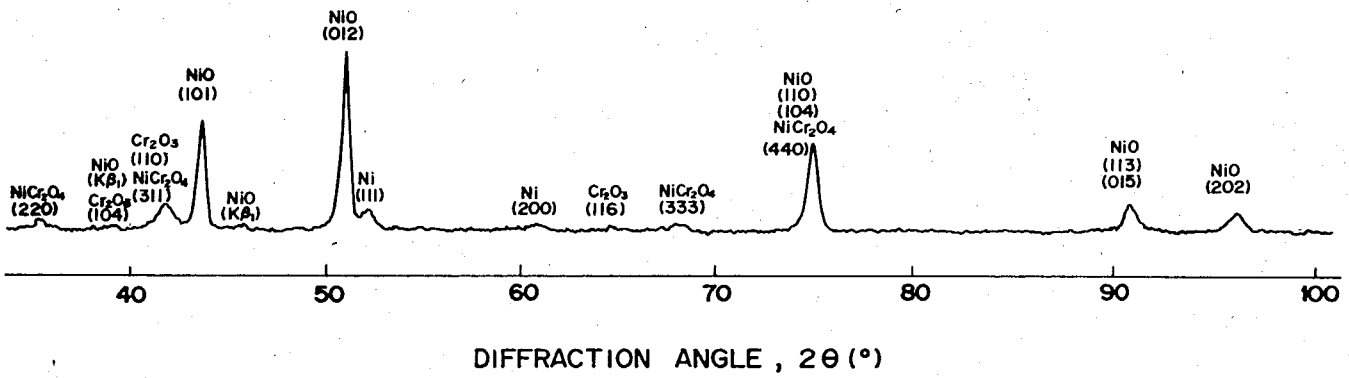

Target: Co
kV - mA: 30 - 10
Filter: Fe
Full Scale: $4\times10^3$c/s
Time Const.: 2 sec.
Scanning Speed: 4°/min.
Chart Speed: 40 mm/min.
Solar Slit: 0.3°
Divergency Slit: 1°
Receiving Slit: 0.3 mm
Detector: scintillation counter;

FIG. 3 shows an X-ray diffraction pattern (scale: about one-third of the real chart) of a nickel oxide-chromium type coating having a chromium component in a proportion, in terms of atomic percentage, of 20% and a degree of oxidation of 89%, which pattern was obtained by X-ray diffractometry under the following conditions:

Target: Co
kV - mA: 30 - 10
Filter: Fe
Full Scale: $2\times10^3$ c/s
Time Const.: 2 sec.
Scanning Speed: 4°/min.
Chart Speed: 40 mm/min.
Solar Slit: 0.3°
Divergency Slit: 1°
Receiving Slit: 0.3 mm
Detector: scintillation counter; and FIG. 4 shows an X-ray diffraction pattern (scale: about one-third of the real chart) of a nickel oxide-chromium type coating having a chromium component in a proportion, in terms of atomic percentage, of 33% and a degree of oxidation of 91%, which pattern was obtained by X-ray diffractometry under the following conditions:

Target: Co
kV - mA: 30 - 10
Filter: Fe
Full Scale: $2\times10^3$ c/s
Time Const.: 2 sec.
Scanning Speed: 4°/min.
Chart Speed: 40 mm/min.
Solar Slit: 0.3°
Divergency Slit: 1°
Receiving Slit: 0.3 mm
Detector: scintillation counter.

DETAILED DESCRIPTION OF THE INVENTION

In one aspect of the present invention, there is provided a hydrogen-evolution electrode comprising an electrically conductive substrate having thereon a coating comprising a chromium component and an oxide of at least one metal selected from the group consisting of nickel and cobalt, said chromium component being present in a proportion, in terms of atomic percentage, of 0.5 to 20%, said atomic percentage being defined by the following formula $$\frac{A_{Cr}}{A_T} \times 100 \quad (1)$$

wherein $A_{Cr}$ represents the number of chromium atoms in the coating and $A_T$ represents the total number of atoms of chromium and said at least one metal in the coating.

In the present invention, the coating may be composed of a chromium component and an oxide of at least one metal selected from nickel and cobalt or may be composed of a chromium component, an oxide of at least one metal selected from nickel and cobalt and at least one metal selected from nickel and cobalt. Especially preferred is a coating containing a chromium component, nickel and nickel oxide.

The term "chromium component" used herein is intended to mean chromium per se and/or a substance composed of chromium and atoms associated with the chromium which is caused to be contained in a coating produced by melt-spraying a mixture of at least one member selected from the first group consisting of nickel, cobalt, oxides of nickel and cobalt, hydroxides of nickel and cobalt, organic acid salts of nickel and cobalt and inorganic acid salts of nickel and cobalt, and at least one member selected from the second group consisting of chromium, an oxide of chromium, a hydroxide of chromium, an organic acid salt of chromium and an inorganic acid salt of chromium; which is caused to be contained in a coating produced by applying onto a substrate a homogeneous solution containing a salt of at least one metal selected from nickel and cobalt and a salt of chromium, followed by sintering in an oxygen-containing atmosphere; or which is caused to be contained in a coating produced by electroplating and/or chemical plating of a substrate in a homogeneous solution containing a salt of at least one metal selected from nickel and cobalt and a salt of chromium, followed by oxidative-calcination in an oxygen-containing atmosphere.

The content of a chromium component in the coating, as mentioned above, is expressed, in terms of atomic percentage, by the formula $$\frac{A_{Cr}}{A_T} \times 100 \quad (1)$$

wherein $A_{Cr}$ represents the number of chromium atoms in the coating and $A_T$ represents the total number of atoms of chrominum and at least one metal selected from nickel and cobalt in the coating.

The content of a chromium component in the coating may be determined by the atomic absorption method.

The term "oxide of at least one metal selected from the group consisting of nickel and cobalt" used herein is intended to include nickel oxide, cobalt oxide and a mixture of nickel oxide and cobalt oxide.

The term "degree of oxidation" used herein is intended to indicate the value (%) of the formula $$\frac{H_1}{H_1 + H_0} \times 100$$

wherein $H_0$ represents the height of a peak of the highest intensity X-ray diffraction line of a metal selected from the group consisting of nickel and cobalt when the coating is analyzed by X-ray diffractometry, or represents the arithmetic mean of the heights of peaks of the highest intensity X-ray diffraction lines respectively of nickel and cobalt in case the coating contains both nickel and cobalt; $H_1$ represents the height of a peak of the highest intensity X-ray diffraction line of an oxide of said metal, or represents the arithmetic mean of the heights of peaks of the highest intensity X-ray diffraction lines respectively of nickel oxide and cobalt oxide in case the coating contains both nickel oxide and cobalt oxide.

The term "reduction resistance" used herein is intended to mean such a property that the oxide as an active material in the electrode coating is not reduced and remains as an oxide even after the continuous operation of electrolysis involving a hydrogen-evolution reaction.

In the electrode of the present invention, an oxide of at least one metal selected from the group consisting of nickel and cobalt in the coating enables the electrode to have high catalytic activity, that is, enables the electrode to exhibit low hydrogen overvoltage. On the other hand, a chromium component in the coating of an electrode imparts reduction resistance to the oxide contained as an active material in the coating.

In the present invention, the coating of an electrode contains a chromium component in a proportion, in terms of atomic percentage as defined by the formula (1), of 0.5 to 20%. When the content of a chromium component in the coating of an electrode is less than 0.5%, the reduction resistance of the oxide in the coating is low so that the degree of oxidation in the coating is considerably decreased during the course of electrolysis, causing the activity of the electrode to be lost to increase the hydrogen overvoltage. On the other hand, when the content of a chromium component in the coating of an electrode is more than 20%, the reduction resistance of the oxide in the coating is so high that the degree of oxidation of the coating is hardly decreased. However, in this case, the activity of the electrode is low even at the initial stage of electrolysis and the effect of lowering the hydrogen overvoltage cannot be attained. This fact is illustratively shown in FIG. 1-(1) and FIG. 1-(2). In FIG. 1-(1), there is shown a graph showing the relationship between the degree of oxidation of the coating of a nickel oxide-chromium type coating electrode, the content of a chromium component in the coating of the electrode and the hydrogen overvoltage which the electrode exhibits, at the initial stage of electrolysis. In FIG. 1-(2) there is shown a graph showing the relationship between the degree of oxidation of the coating of a nickel oxide-chromium type coating electrode, the content of a chromium component in the coating of the electrode and the hydrogen overvoltage which the electrode exhibits after the 10-month operation of electrolysis. In preparing these graphs, sample electrodes were produced in substantially the same manner as in Example 1 to be given later, except that the amount of chromium oxide to be melt sprayed was varied; the hydrogen overvoltage which each electrode exhibits was determined in substantially the same electrolysis conditions as in Example 1 according to the later-mentioned method; and the content of a chromium component in the coating of each electrode was determined according to the later-mentioned method. From FIG. 1-(1) and FIG. 1-(2), it is noted that even when the content of a chromium component is relatively high, the degree of oxidation of the coating after the 10-month operation of electrolysis is decreased by only about 10% as compared with that at the initial stage of electrolysis. This does not mean that the oxide in the coating is reduced during the course of electrolysis. This is believed to be mainly attributed to the removal of an instable part of the oxide in the coating at a relatively initial stage of electrolysis. FIG. 1-(1) and FIG. 1-(2) show that when the content of a chromium component in the coating is in a specific range, the electrode not only exhibits low hydrogen overvoltage but also has high durability. In the electrode of the present invention of which the coating contains a chromium component in a proportion, in terms of atomic percentage as defined by the formula (1), of 0.5 to 20%, even after the electrode is continuously used in an electrolysis involving a hydrogen-evolution reaction more than one year, the electrode exhibits extremely low hydrogen overvoltage. In the case of a cobalt oxide-chromium type coating electrode or a nickel oxide-cobalt oxide-chromium type coating electrode, also, the same explanation mentioned in connection with FIG. 1-(1) and FIG. 1-(2) is applicable.

Figure 2:
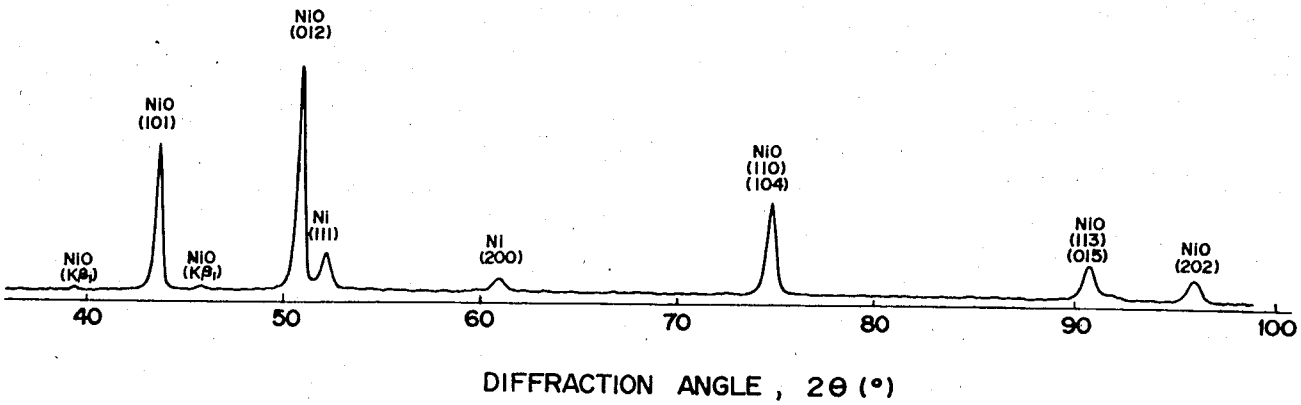
FIG. 2 shows an X-ray diffraction pattern (scale: about one-third of the real chart) of a nickel oxide-chromium type coating having a chromium component in a proportion, in terms of atomic percentage, of 9.0% and a degree of oxidation of 86%, which pattern was obtained by X-ray diffractometry under the following conditions.

Turning now to FIGS. 2 to 4, there are given X-ray diffraction patterns of electrode coatings. X-ray diffraction analysis was carried out using Diffraction Apparatus SG-7 and X-ray Generator 4036 A-2 (both of which are manufactured and sold by Rigaku Corporation, Japan). FIG. 2 is an X-ray diffraction pattern of the coating of the electrode prepared in Example 1 to be given later, which coating contains a chromium component in a proportion, in terms of atomic percentage as defined by the formula (1), of 9.0% and has a degree of oxidation of 86%. FIG. 3 is another X-ray diffraction pattern of the coating of the electrode prepared in Example 5 to be given later, which coating contains a chromium component in a proportion, in terms of atomic percentage as defined by the formula (1), of 20% and has a degree of oxidation of 89%. In FIGS. 2 and 3, only peaks attributed to nickel oxide (NiO) and peaks attributed to metal nickel (Ni) are observed and no peak attributed to the compound oxide of nickel-chromium ($NiCr_2O_4$) is observed. In FIGS. 2 and 3 any peaks attributed to chromium oxide ($Cr_2O_3$) and any peaks attributed to metal chromium (Cr) are not observed. This suggests that chromium oxide ($Cr_2O_3$) and/or chromium (Cr) are in an amorphous state or in a state of a solid solution in the coating. FIG. 4 is still another X-ray diffraction pattern of the coating of the electrode obtained in Comparative Example 4 to be given later, which coating contains a chromium component in a proportion, in terms of atomic percentage as defined by the formula (1), of 33% and has a degree of oxidation of 91%. In FIG. 4, peaks attriubted to the compound oxide of nickel-chromium ($NiCr_2O_4$) and peaks attributed to chromium oxide ($Cr_2O_3$) as well as peaks attributed to nickel oxide (NiO) and peaks attributed to metal nickel (Ni) are observed. The electrode having a coating of which the X-ray diffraction pattern is shown in FIG. 4 and which contains a chromium component in a proportion, in terms of atomic percentage defined by the formula (1), of more than 20% is low in activity and exhibits high hydrogen overvoltage. In the case of a cobalt oxide-chromium type coating electrode or a nickel oxide-cobalt oxide-chromium type coating electrode, also, an explanation similar to the explanation mentioned in connection with FIGS. 2 and 3 is applicable. The coating of an electrode of the present invention contains a chromium component in a proportion, in terms of atomic percentage as defined by the formula (1), of 0.5 to 20%, but does not contain any compound oxides which may possibly be produced from nickel, cobalt and chromium and which are low in activity.

An oxide of at least one metal selected from the group consisting of nickel and cobalt contained in the coating of the present invention may be nickel oxide, cobalt oxide or a mixture thereof. However, a compound oxide containing nickel or cobalt which is poor in catalytic activity is not suitable for the purpose of the present invention. Among oxides to be contained in the coating of the electrode of the present invention, nickel oxide is most preferred. Cobalt oxide is suitable for the purpose of the present invention. However, detailed comparison between nickel oxide and cobalt oxide shows that nickel oxide is excellent in activity as compared with cobalt oxide.

In the present invention, the degree of oxidation of the coating of an electrode may be 100%, that is, the coating may be composed of a chromium component and an oxide of at least one metal selected from nickel and cobalt. Preferably, the degree of oxidation of the coating of an electrode may be 20 to less than 100%, more preferably 30 to 90%. The degree of oxidation of an electrode coating is, as mentioned above, determined by X-ray diffractometry. In the electrode coating containing an oxide of at least one metal selected from the group consisting of nickel and cobalt, it is experimentally confirmed that the value of the degree of oxidation is nearly equal to the value of mole % of the oxide based on the composition of the coating. Where the content of a chromium component of the coating of an electrode is 0.5 to 20% but the degree of oxidation of the coating of the electrode is less than 20%, the activity of the metal portion of the coating of the electrode becomes low during the course of electrolysis, causing the activity of the electrode as a whole to be decreased. Therefore, as mentioned above, the degree of oxidation is preferably more than 20%.

In the foregoing, the description has been made with respect to an electrode having a coating composed of a chromium component and an oxide of at least one metal selected from nickel and cobalt or an electrode having a coating composed of a chromium component, an oxide of at least one metal selected from nickel and cobalt and at least one metal selected from nickel and cobalt. In the electrode of the present invention, however, the coating may contain one or more metals or metal-containing substances other than a chromium component, an oxide of at least one metal selected from nickel and cobalt and at least one metal selected from nickel and cobalt. As examples of such other metals or metal-containing substances which may be used in the present invention, there can be mentioned zinc, zinc oxide, aluminum, silicon dioxide, molybdenum, molybdenum oxide and the like. The employment such other metals or metal-containing substances serves to further improve the activity of the resulting electrode and further decreases the hydrogen overvoltage. In the coating containing such other metals or metal-containing substances, it is preferred that the composition of the coating be such as will be described with respect to the following two different cases.

Case 1: where the coating of an electrode does not contain metal nickel or metal cobalt, the total content of a chromium component plus an oxide of at least one metal selected from nickel and cobalt in the coating is expressed, in terms of atomic percentage, by the following formula $$\frac{A_{Cr} + A_{MO}}{A_T} \times 100 \qquad (2)$$

wherein $A_{Cr}$ represents the number of chromium atoms in the coating; $A_{MO}$ represents the number of atoms of at least one metal selected from nickel and cobalt attributed to the oxide thereof in the coating; and $A_T$ represents the total number of atoms of chromium, at least one metal selected from nickel and cobalt attributed to the oxide thereof and one or more kinds of metals or metals of metal-containing substances other than the above in the coating.

In the present invention, the total content of a chromium component plus an oxide of at least one metal selected from the group consisting of nickel and cobalt in the coating is preferably more than 60% in terms of the atomic percentage as defined by the formula (2). From the viewpoints of electrode activity and durability of an electrode, the total content of a chromium component plus an oxide of at least one metal selected from the group consisting of nickel and cobalt is more preferably more than 80% in terms of the atomic percentage as defined by the formula (2).

Case 2: where the coating of an electrode contains metal nickel and/or metal cobalt, also, the total content of a chromium component plus an oxide of at least one metal selected from nickel and cobalt plus at least one metal selected from nickel and cobalt in the coating is expressed, in terms of atomic percentage, by the following formula (3)

$$\frac{A_{Cr} + A_{MO} + A_M}{A_{T''}} \times 100 \qquad (3)$$

wherein $A_{Cr}$ represents the number of chromium atoms in the coating; $A_{MO}$ represents the number of atoms of at least one metal selected from nickel and cobalt attributed to the oxide thereof in the coating; $A_M$ represents at least one metal selected from nickel and cobalt attributed to the single metal in the coating; $A_{T''}$ represents the total number of atoms of chromium, at least one metal selected from nickel and cobalt attributed to the oxide thereof, at least one metal selected from nickel and cobalt attributed to the single metal and one or more kinds of metals or metals of metal-containing substances other than the above in the coating.

In such case, the total content of a chromium component plus an oxide of at least one metal selected from nickel and cobalt plus at least one metal selected from nickel and cobalt in the coating is preferably more than 60% in terms of atomic percentage as defined by the formula (3), more preferably more than 80% in terms of atomic percentage as defined by the formula (3) from the viewpoints of electrode activity and durability of an electrode.

Both the total content of a chromium component plus an oxide of at least one metal selected from nickel and cobalt and the total content of a chromium component plus an oxide of at least one metal selected from nickel and cobalt plus at least one metal selected from nickel and cobalt can also be determined by the atomic absorption method.

Explanation will now be made on an electrically conductive substrate to be used in the present invention. The electrically conductive substrate of electrode should be sufficiently resistant to an electrolytic solution not only at a potential of the substrate during the electrolysis but also at a potential of the substrate at the time when the electrolysis is not effected. The surface of a substrate having an active, porous coating thereon has a potential which is noble as compared with the potential on the surface of the coating even during a period of time in which hydrogen is evolved from the surface of the coating of the electrode. Therefore, it is not unusual that the potential at the surface of the substrate is noble as compared with the dissolution-deposition equilibrium potential of iron. For this reason, in case iron is used as the substrate of electrode, the iron is corroded and dissolved out from the surface of the substrate. As a result, the electrolytic solution and the electrode coating are contaminated and, in an extreme case, the coating of electrode is caused to be exfoliated and comes off from the surface of electrode so that the activity of the electrode is greatly decreased. As examples of the material which has an anticorrosive property sufficient for use as the substrate of electrode of the present invention and is commercially easily available, there may be mentioned, for example, nickel, a nickel alloy, an austenite type stainless steel and a ferrite type stainless steel. Of the above-mentioned materials, nickel, a nickel alloy and an austenite type stainless steel are preferred, and nickel and a nickel alloy are particularly preferred. Besides, those which each are composed of an electrically conductive substrate having on its surface a non-pinhole coating of nickel, a nickel alloy, an austenite type stainless steel or a ferrite type stainless steel may also preferably be used as the substrate of electrode. Such a non-pinhole and anticorrosive coating may be obtained by known techniques, for example, electroplating, electroless plating, melt-plating, rolling, pressure-adhesion by explosion, clothing of metal, vapor deposition, ionization plating and the like.

The preferred shape of the substrate of electrode is of such a structure that hydrogen gas generated during the electrolysis is smoothly released so that a superfluous voltage loss due to the current-shielding by the hydrogen gas may be avoided and that the effective surface area for electrolysis is large so that the current is hardly concentrated. The substrate having such a shape as mentioned above may be made of a wire screen having a suitable wire diameter and spacing between the mutually adjacent wires, a perforated metal having a suitable thickness, size of opening and pitch of opening arrangement, an expanded metal having suitable lengths of long axis and short axis, or the like.

Next, with respect to the method of forming a coating on the electrically conductive substrate in the present invention, there may be employed various techniques, for example, a method comprising applying onto the substrate a homogeneous solution containing a salt of at least one metal selected from nickel and cobalt and a salt of chromium, followed by baking in an oxygen-containing atmosphere; a method comprising melt-spraying, such as plasma spraying and flame spraying, a mixture of a powder of at least one metal selected from nickel and cobalt or an oxide thereof or a compound of said at least one metal capable of forming such an oxide and a powder of chromium or an oxide thereof or a compound of chromium capable of forming chromium oxide; and a method comprising electroplating and/or chemical plating of the substrate in a homogeneous solution containing a salt of at least one metal selected from nickel and cobalt and a salt of chromium, followed by oxidative-calcination in an oxygen-containing atmosphere.

In the above-mentioned method comprising applying a homogeneous solution of metal salts followed by baking, examples of the suitable salts of nickel, cobalt and chromium are nitrate, chloride, formate, acetate and oxalate salts of such metals.

In the above-mentioned method comprising melt-spraying, examples of the suitable powder are those consisting of oxides, hydroxides, carbonates, formates and/or oxalates of nickel, cobalt and chromium and/or such metals per se. Of them, powders of oxides of such metals are most preferable.

In the above-mentioned method comprising electroplating and/or chemical plating followed by oxidative-calcination, suitable examples of the salts of nickel, cobalt and chromium are sulfate, chloride, nitrate, acetate and trichloroacetate salts of such metals.

Of these methods, the method comprising melt-spraying is most preferable, for it ensures complete coating with a predetermined composition and gives an electrode having a high activity which can be utilized for a prolonged period of time. Illustratively stated, according to this method, the operations of melting of the powder and solidification and coating formation of the melted material on the substrate can be accomplished instantaneously. Hence, a non-stoichiometric composition tends to be formed. This is believed to be the reason why an electrode coating having a high activity can be obtained by melt-spraying. Moreover, a uniform composition consisting of a plurality of components may be obtained with certainty by the use of relatively easy and secure techniques, such as mixing and granulation. By melt-spraying such a uniform composition, it is possible to obtain the desirable electrode coating freely. Therefore, the melt-spraying method is one of the most suitable methods for the purpose of the present invention, which is to provide a hydrogen-evolution electrode, with a coating of a plurality of components thereon, having a high activity and long life. With respect to the melt-spraying method, it is important to improve the affinity between the active material of the electrode and the material giving reduction resistance thereto so that they may fully exhibit their respective functions. This is so from the viewpoint of attaining the purpose of the present invention which is to provide a hydrogen-evolution electrode having a high activity and long life. For the foregoing reason, it is preferred that the starting powders of the material giving electrode activity and the material giving reduction resistance thereto be sufficiently mixed, milled and formed into granules before being subjected to melt-spraying.

The particle size or diameter of the starting powder to be employed in the present invention is preferably not greater than 5 μm, more preferably 0.02 μm to 5 μm. When a starting powder has a particle size greater than 5 μm, it is desirable to reduce the particle size by means of milling and classification. Milling may be performed by employing a conventional milling apparatus, such as ball mill, centrifugal mill, rod mill, centrifugal roll mill, high-speed rotary hammer mill, premier colloid mill and Pearl Mill (trade name of a wet mill provided with beads and a rotary agitator, manufactured and sold by Drais Co., West Germany). It is to be noted, however, that the milling apparatus to be employed in the present invention is not limited to the above. Generally, wet milling is more preferable than dry milling since the former is advantageous to attain good dispersion of particles which helps to improve the uniformity of the resulting material quality. At any rate, the purpose of the milling resides in increasing the surface area of individual particles as well as the contact area of different kinds of starting material particles thereby to provide an electrode having an improved activity and reduction resistance.

Desirably, the powders having a particle size not greater than 5 μm is subjected to granulation. The term "granulation" as used herein means formation of granules having a uniform shape and size, in which each component is uniformly distributed and bonded with uniform bonding strength, from a plurality of minute powder particles. When the minute powder is melt-sprayed without being subjected to the above-mentioned granulation, the components for constituting the active sites of the electrode tend to separate from the components for imparting reduction resistance to the active sites due to the differences in particle size and specific gravity. Hence, it is difficult to obtain a favorable interaction for the two kinds of components. As a result, the overvoltage of the electrode tends to increase with the lapse of time. Therefore, without granulation, it is difficult to obtain an electrode exhibiting a stable performance. Further, without granulation, it is also difficult to perform melt-spraying on a commercial scale because it is accompanied by various problems. For example, the powder without granulation is difficult to feed at a fixed rate to a melt-spraying flame. Moreover, there occurs a large volume of dust which causes the work environment to degrade and markedly lowers melt-spraying yield and productivity. Therefore, it is preferred to subject the powders to granulation. In the present invention, it is not requisite to subject the powders having a particle size not greater than 5 μm to granulation. However, when the powders per se are used, the above-mentioned problems are encountered.

Various granulation techniques may be employed. They may be classified into several categories according to the type of apparatus, the state of starting material, the granule-forming mechanism or the like. For example, the granulation of powder may be carried out by means of a rotary drum-type apparatus or rotary dish-type apparatus in which a mixture of powder and liquid is formed into granules due to capillary absorption action and/or chemical reaction. It may also be carried out by means of a spraying and drying-type apparatus in which a material in the form of solution or suspension is formed into granules due to surface tension, drying and crystallization. Further, it may be carried out by means of a spraying and air cooling-type apparatus or spraying and water cooling-type apparatus in which a molten material is formed into granules due to surface tension, cooling and crystallization. Any of the above-cited granulation techniques provide substantially spherical granules. Of the above-cited granulation techniques, that by means of a spraying and drying-type apparatus is most preferable because it has some advantages, such as facilitating the application of an active coating since uniformly porous granules are obtained, formation of well-bonded granules, facility in granule size control and low cost.

Some detailed explanation is given below with respect to the granulation technique by means of a spraying and drying-type apparatus. According to the method, a homogeneous suspension or solution may first be prepared from a powder, binding agent and water. Second, the suspension or solution may be sprayed through a rotary disc, two-channel nozzle, pressure nozzle or the like to form liquid droplets. Third, the liquid droplets may be dried, thereby to obtain granules having a uniform composition, uniform shape and uniform size of which the components are bonded with uniform bonding strength.

As the suitable binding agent to be employed for preparing granules in the present invention, there may be mentioned water-soluble polymeric organic materials, such as polyvinyl alcohol, polyvinyl acetate, gum arabic, carboxymethyl cellulose, methyl cellulose, ethyl cellulose and the like. These polymeric organic materials serve as the binding agent of component particulate materials during the granule-forming stage thereby to provide granules of which the components are bonded with certain bonding strength. During the melt-spraying stage, however, they almost completely disappear due to combustion or decomposition so that they exert no adverse effect on the resulting coating over the electrode.

To stabilize the above-mentioned suspension or solution to be employed in the granulation for the purpose of obtaining uniform granules, there may be added a dispersant, antiflocculating agent, surfactant, antiseptic and the like. In selecting these agents, the most suitable types must be selected in consideration of their effect on the active coating over the electrode. As examples of the dispersant, there may be mentioned a sodium salt of carboxymethyl cellulose having a molecular weight of $200\times10^3$ or more, methyl cellulose having a molecular weight of $140\times10^3$ or more, polyethylene glycol having a molecular weight of $120\times10^3$ or more and the like. As examples of the antiflocculating agent, there may be mentioned sodium hexametaphosphate, ammonium citrate, ammonium oxalate, ammonium tartrate, monoethylamine and the like. As examples of the surfactant, there may be mentioned alkyl aryl phosphates, alkyl aryl sulfonate, fatty acid soap and the like. As examples of the antiseptic, there may be mentioned sodium phenoxide, phenol, phenol derivatives, formaldehyde and the like. Generally, it is preferred that the powder material concentration of the suspension or solution be in the range of from 30 to 90% by weight.

The size of the granules to be employed in the present invention may be in the range of preferably from 1 to 200 μm, more preferably from 5 to 100 μm. When the granule size is too small, especially less than 1 μm, a large volume of dust occurs during the melt-spraying stage. This markedly lowers melt-spraying yield, thereby causing performance of melt-spraying on a commercial scale to be difficult. On the other hand, when the granule size is too large, especially more than 200 μm, there occur problems, such as degradation of electrode activity, shortening of electrode life, decrease of coating strength and fall of melt-spraying yield which are primarily attributed to incomplete melting of the material.

It is preferred that the granules have a crushing strength of 0.5 g/granule or more. Such a level of crushing strength is needed to maintain their morphology during the storage and transportation after the granule formation. The crushing strength of the granules can be varied by changing the amount and/or kind of the binding agent to be employed.

As the suitable method for melt-spraying the granules in the present invention, there may be mentioned, for example, flame spraying and plasma spraying. Of the above-cited techniques, plasma spraying is more preferable.

Some detailed explanation is given below with respect to the plasma spraying method. According to the method, dissociation and ionization of at least one kind of gas selected from argon, nitrogen, hydrogen, helium and other gases may be caused to occur by passing the gas through a direct-current arc slit. This enables a plasma flame having such a high temperature as several thousand to some ten thousand degrees centigrade, a certain heat capacity and a high speed to be taken out. The granules may be conveyed by an inert gas and poured in the plasma flame. The granules poured in the plasma flame will melt fly and collide against the surface of the electrode substrate. Then, the molten material on the electrode substrate may be cooled and solidified. The above-mentioned melting, flight and collision of the material may be accomplished instantaneously, for example, generally in a period of from 0.1 to 10 milliseconds. The temperature, heat capacity and speed of the plasma flame primarily depend on the kind of the gas employed and the power of the arc. As the suitable gas to be employed for producing the plasma flame, there may be mentioned mixtures of gases, such as those of argon and nitrogen, argon and hydrogen, and nitrogen and hydrogen. The power of the arc is determined by the arc current and arc voltage. The arc voltage, at a fixed arc current, is determined by the inter-electrode distance and the kind and flow rate of plasma gas. When a gas requiring much energy for dissociation and ionization of molecules, such as nitrogen, is employed, the arc voltage generally tends to increase. On the other hand, when a gas which consists of single-atom molecules and can be readily ionized, such as argon, is employed, the arc voltage generally tends to decrease. At any rate, the power of the arc must be sufficient to provide a plasma flame having a temperature and heat capacity enough to accomplish the above-mentioned melting of the powder material in the form of granules instantaneously.

As the other conditions affecting the melt-spraying, there may be mentioned the distance from the spray nozzle to the substrate to be spray coated and the angle at which the spray nozzle is disposed with respect to the face of the substrate to be spray coated. Generally, the distance from the spray nozzle to the substrate to be coated is preferably 50 to 300 mm, and the angle at which the spray nozzle is disposed with respect to the substrate to be coated is preferably 30° to 150°. Further, the method for pouring the powder or granule in the plasma flame and the method for cooling the melt-sprayed material may affect the melt-spraying. However, these conditions are not of critical nature and may be chosen from the conditions customarily employed.

The degree of oxidation of the coating can be varied by changing the ratio of a powder metal to a powder metal oxide and/or by changing the oxygen concentration of the melt-spraying atmosphere.

In addition to the material giving electrode activity and the material giving reduction resistance, a third component selected from zinc, zinc oxide, aluminum, silicon dioxide, molybdenum, molybdenum oxide and other substances may be incorporated in the powder to be employed in the present invention. This is advantageous, for it further improves the activity of the resulting electrode and further decreases the hydrogen overvoltage.

The preferred thickness of the coating of electrode is 10 to 300 μm. Where the thickness of the coating is less than 10 μm, there cannot be obtained an electrode exhibiting a satisfactorily lowered hydrogen overvoltage. On the other hand, the increase in thickness of the coating to more than 300 μm is not advantageous from an economical viewpoint because even if the coating thickness is more than 300 μm, the hydrogen overvoltage does not exceed a certain value and the increase of thickness of the coating to more than 300 μm only causes the cost for the coating to be increased without any proportional advantage. With respect to the face of an electrode to be coated, there is not a specific restriction. According to need or according to the manner of use of the electrode, a coating may be formed on the electrode at its one side or both sides or at its partial portions. In determining the face of electrode to be coated, there may be adopted a method in which the desired degree of lowering of hydrogen overvoltage of the electrode is taken into consideration. For example, a relatively thick coating may be formed with respect to the portions of an electrode at which a great amount of current flows, and a thin film may be formed with respect to the portions of an electrode at which a small amount of current flows.

It is preferable to subject an electrically conductive substrate to a pre-treatment prior to melt-spraying. The pre-treatment consists in degreasing and grinding the surface of substrate. By the pre-treatment, the stains on the surface of substrate are removed and the surface of substrate is appropriately coarsened, thereby enabling great bonding between the substrate and the melt-sprayed coating to be obtained. With respect to the method of pre-treatment, there is not any particular restriction. Usually, there may be employed grinding by an acid-etching, a blast finishing (for example, grit blasting, shot blasting, sand blasting or liquid honing), an electrolytic grinding or the like in combination with degreasing by means of an organic liquid, a surfactant, vapor, calcination or the like.

The electrode of the present invention can be effectively used as a hydrogen-evolution cathode in the electrolysis of sodium chloride by the ion exchange membrane process or the diaphragm process, electrolysis of alkali metal halides other than sodium chloride, electrolysis of water, electrolysis of Glauber's salt and the like. It is preferred that an electrolytic solution to be in contact with the electrode of the present invention be alkaline. The type of an electrolytic cell to be used together with the electrode of this invention may be of either monopolar arrangement or bipolar arrangement. When the electrode of the present invention is used in the electrolysis of water, it may be used as a bipolar electrode.

The present invention will be further illustrated in more detail with reference to the following Examples which should not be construed to be limiting the scope of the present invention.

In the Examples, various measurements were done as follows.

The content of a chromium component in the coating of an electrode (hereinafter often referred to as "chromium component content") is determined by the atomic absorption method as follows.

One part by weight of the coating of an electrode is mixed with 50 parts by weight of a flux (a mixture of 2 parts by weight of sodium peroxide and one part by weight of sodium carbonate) and the resulting mixture is melted. A predetermined amount of hot water and aqueous 50% sulfuric acid are added to the resulting mixture to obtain a homogeneous solution. The obtained solution is used as the sample. The experimental conditions (wave length and kind of flame) and apparatus used are as follows.

| Kind of atom | Wave length (Å) | Kind of flame | Apparatus |
|---|---|---|---|
| Ni | 2320 | acetylene-air | atomic absorption analyzer AA 1 (manufactured and sold by Nippon Jarrell-Ash Co. Ltd., Japan) |
| Co | 2407 | " | atomic absorption analyzer AA 1 (manufactured and sold by Nippon Jarrell-Ash Co. Ltd., Japan) |
| Cr | 3579 | " | atomic absorption analyzer AA 1 (manufactured and sold by Nippon Jarrell-Ash Co. Ltd., Japan) |
| Si | 2516 | acetylene-nitrous oxide | atomic absorption analyzer AA 8500 (manufactured and sold by Nippon Jarrell-Ash Co. Ltd. Japan) |

The following values are obtained as follows.

Diameter of granules

The electron microscopic method

Water content of granules

The infrared drying method

Spraying yield $$\text{Spraying yield (\%)} = \frac{\text{Weight of electrode (g)} - \text{Weight of substrate (g)}}{\text{Amount of powder supplied (g)}} \times 100$$

Crushing strength

Granules having a diameter of 30–44 μm are classified by means of a sieve. The minimum load (g) to crush a granule is determined with respect to 30 granules. The obtained values of load (g) are averaged.

Degree of Oxidation

X-ray diffractometry

EXAMPLE 1

100 Parts by weight of powder nickel oxide (NiO) having particle diameters ranging from 0.2 to 2 μm and 10 parts by weight of powder chromium oxide ($Cr_2O_3$) having particle diameters ranging from 0.5 to 3 μm were added to an aqueous solution consisting of 100 parts by weight of water, 2.25 parts by weight of gum arabic as a binder, 0.7 part by weight of sodium carboxymethyl cellulose as a dispersant, 0.1 part by weight of sodium hexametaphosphate as an antiflocculating agent, 0.001 part by weight of sodium lauryl sulfate as a surfactant and 0.1 part by weight of phenol as an antiseptic agent. The resulting mixture was vigorously stirred to obtain a homogeneous suspension.

The thus obtained suspension was dried and granulated by means of a spray dryer type granulation chamber (hereinafter often referred to simply as "granulation chamber") having a diameter of 1 m and a height of 0.7 m and equipped at its top with a rotating disc. In this step, the suspension was fed to the granulation chamber at the rotating disc being rotated at 25,000 r.p.m. at a feed rate of 40 kg/hr by means of a pump, whereby the suspension became droplets and was dispersed while being subjected to gravity-drop toward the bottom of the granulation chamber. Hot air of 330° C. was fed to the granulation chamber so that the hot air flowed in the same direction as the dispersed droplets fell. The flow rate of the hot air was adjusted so that the hot-air temperature was 120° C. at the outlet of the hot air located at the side portion of the bottom of the granulation chamber. Spherical granules having temperatures of 95° to 100° C. were produced at a production rate of about 18 kg/hr. The produced granules were taken out from the bottom of the granulation chamber and allowed to stand for cooling. The obtained granules were 5 to 50 μm in diameter as determined by the electron microscopic method, 5 g/granule in crushing strength and less than 0.1% in water content.

A 5 cm×5 cm nickel wire screen (wire diameter, 0.7 mm; 12 mesh) was degreased with trichlene, and then blasted by means of $Al_2O_3$ having a particle size of 0.73 to 2.12 mm. The blasted wire screen (substrate) was melt spray coated on each side thereof with the above-prepared granules by plasma spraying as indicated below. The plasma spraying was repeated 3 times with respect to each side of the wire screen to produce an electrode having a coating of a thickness of 120 μm with respect to each side of the wire screen.

Plasma spraying was done using the following average spraying parameters.

Feeding rate of plasma gas of argon and nitrogen: 1 $m^3$ (at normal state)/hr and 0.8 $m^3$ (at normal state)/hr, respectively Feeding rate of granules to plasma flame from a hopper (carrier gas: argon): 5.0 kg/hr Plasma arc (current): 700 A Voltage between electrodes: about 50 V Distance between substrate and spray gun (spray distance): 10 cm Angle of the plasma flame relative to the face of the substrate: 90°

The spraying yield of the granules was 60%, that is, the granules were coated on the substrate at a rate of 3.0 kg/hr.

The resulting electrode was analyzed by X-ray diffraction to determine the degree of oxidation of the coating by calculation from a height of the peak attributed to crystal face (012) with respect to NiO and a height of the peak attributed to crystal face (111) with respect to Ni, respectively. The values of degrees of oxidation [NiO/NiO+Ni (×100)] of the coating was 86% but not 100%. This is due to partial reduction of nickel oxide in the plasma flame. The analysis by X-ray diffractometry showed the absence of a compound oxide of nickel-chromium ($NiCr_2O_4$) in the coating. The chromium component content of the coating was 9.0%. The X-ray diffraction pattern of the coating of the electrode are shown in FIG. 2.

There was provided an electrolytic cell which is partitioned by a carboxylic acid type cation exchange membrane commercially available under the trade name "Aciplex K-105" (manufactured and sold by Asahi Kasei Kogyo K.K., Japan) into a cathode chamber accommodating therein a cathode and an anode chamber accommodating therein an anode made of a titanium-made expanded metal having thereon a coating composed of ruthenium oxide, zirconium oxide and titanium oxide. As the cathode, the above-obtained electrode was used in the electrolytic cell. While supplying brine having a NaCl concentration of 175 g/liter into an anode chamber and supplying a 30% aqueous sodium hydroxide solution into a cathode chamber, electrolysis was continuously conducted at a current density of 40 A/dm$^2$ and at 90° C. The hydrogen overvoltage was measured by the current interrupt method and in such a manner in which Luggin capillary was connected to a reference electrode (Hg/HgO: 25° C.) by means of liquid-junction and in turn was connected to the surface of the cathode facing the cation exchange membrane.

The results are shown below in Table 1.

TABLE 1

| | At initial stage | After 5 months | After 10 months |
|---|---|---|---|
| Hydrogen overvoltage, mV (at 40 A/dm$^2$) | 160 | 150 | 150 |
| Oxidation degree (%)* | 86 | 78 | 78 |

Note:
* $\frac{NiO}{NiO + Ni} \times 100$

As is apparent from Table 1, 5 months after the initiation of the electrolysis, the oxidation degree of the coating of the electrode was lowered by 8% as compared with the oxidation degree at the initial stage of the electrolysis and, thereafter, the oxidation degree was not lowered.

EXAMPLES 2 to 5

100 Parts by weight of powder nickel oxide (NiO) having particle diameters ranging from 0.2 to 2 μm and powder chromium oxide ($Cr_2O_3$) having particle diameters ranging from 0.5 to 3 μm (0.6 part by weight in Example 2, 3.2 parts by weight in Example 3, 5.3 parts by weight in Example 4 and 25.5 parts by weight in Example 5) were mixed in their dry states, and then dried using a dry air of 100° C. for two hours.

Substantially the same procedures as in Example 1 were repeated to prepare electrodes by plasma spraying, except that the above-prepared nickel oxide-chromium oxide powder mixtures per se were used without being subjected to granulation and that the thickness of the coating was 100 μm with respect to one side of electrode and 50 μm with respect to the other side of electrode.

The chromium component content of the coating of each electrode as prepared above was 0.5% in Example 2, 3.0% in Example 3, 5% in Example 4 and 20% in Example 5. The degrees of oxidation [NiO/NiO+Ni (×100)] of the coatings of the electrodes as prepared above were 90% in Examples 2 to 4 and 89% in Example 5. The analysis by X-ray diffractometry showed that the coating of each electrode contained nickel oxide (NiO) and metal nickel (Ni) and that no compound oxide of nickel-chromium was present in the coating of each electrode. The X-ray diffraction pattern of the coating of the electrode prepared in Example 5 is shown in FIG. 3.

Substantially the same procedures as in Example 1 were repeated to effect electrolyses for evaluation of the performance of electrode, except that each electrode as prepared above was used and disposed in the cathode chamber such that the surface of the electrode with a thickness of 100 μm faced the cation exchange membrane.

The results obtained are shown below in Table 2.

TABLE 2

| | Hydrogen overvoltage, mV (at 40 A/dm$^2$) | | | Oxidation degree (%)* | | |
|---|---|---|---|---|---|---|
| Example No. | At initial stage | After 5 months | After 10 months | At initial stage | After 5 months | After 10 months |
| 2 | 160 | 150 | 150 | 90 | 50 | 50 |
| 3 | 160 | 150 | 150 | −90 | 60 | 60 |
| 4 | 160 | 150 | 150 | 90 | 70 | 70 |
| 5 | 170 | 160 | 160 | 89 | 80 | 80 |

Note:
* $\frac{NiO}{NiO + Ni} \times 100$

EXAMPLE 6 to 9

Four kinds of electrodes were prepared in substantially the same manner as described in Example 1, except that 100 parts by weight of powder cobalt oxide (CoO) having particle diameters ranging from 0.4 to 2 μm were employed instead of 100 parts by weight of powder NiO and that the amount of powder chromium oxide ($Cr_2O_3$) having particle diameters ranging from 0.5 to 3 μm was varied to 0.6 part by weight in Example 6, 5.4 parts by weight in Example 7, 11.3 parts by weight in Example 8 and 25.4 parts by weight in Example 9.

The chromium component content of the coating of each of the thus obtained electrodes was 0.5% in Example 6, 5.0% in Example 7, 10% in Example 8 and 20% in Example 9. The degree of oxidation [CoO/CoO+Co (×100)] of the coating of each electrode as prepared above was 95% in Examples 6 to 9. The analysis by X-ray difractometry showed that the coating of each electrode contained cobalt oxide (CoO) and metal cobalt (Co) and that no compound oxide of cobalt-chromium was present in the coating of each electrode.

Substantially the same procedures as in Example 1 were repeated to effect electrolyses for evaluation of the performance of the electrode, except that each electrode as prepared above was used.

The results obtained are shown below in Table 3.

TABLE 3

| Example No. | Hydrogen overvoltage, mV (at 40 A/dm²) At initial stage | After 5 months | After 10 months | Oxidation degree (%)* At initial stage | After 5 months | After 10 months |
|---|---|---|---|---|---|---|
| 6 | 170 | 160 | 160 | 95 | 50 | 50 |
| 7 | 170 | 160 | 160 | 95 | 70 | 70 |
| 8 | 170 | 160 | 160 | 95 | 75 | 75 |
| 9 | 170 | 160 | 160 | 95 | 80 | 80 |

Note:
* $\frac{CoO}{CoO + Co} \times 100$

EXAMPLE 10

An electrode was prepared in substantially the same manner as described in Example 1, except that the amount of powder chromium oxide ($Cr_2O_3$) having particle diameters ranging from 0.5 to 3 μm was varied to 11.4 parts by weight and that 8.1 parts by weight of powder silicon dioxide ($SiO_2$) having particle diameters ranging from 0.5 to 3 μm was employed as an additional component.

The coating of the thus obtained electrode had a chromium component content of 10% and had a silicon component content of 4.2%. The analysis by X-ray diffractometry showed that the coating of the electrode contained nickel oxide (NiO) and metal nickel (Ni) and that no compound oxide of nickel-chromium was present in the coating of the electrode. The degree of oxidation [NiO/NiO+Ni (×100)] of the coating of the above-obtained electrode was 90%.

The electrode thus obtained was then immersed in a 30% aqueous NaOH solution at 90° C. for 24 hours. Thereafter, substantially the same procedures as in Example 1 were repeated to effect an electrolysis for evaluation of the performance of the electrode except that use was made of the electrode as prepared above.

The results obtained are shown below in Table 4.

TABLE 4

| | At initial stage | After 5 months | After 10 months |
|---|---|---|---|
| Hydrogen overvoltage, mV (at 40 A/dm²) | 140 | 130 | 130 |
| Oxidation degree (%)* | 90 | 75 | 75 |

Note:
* $\frac{NiO}{NiO + Ni} \times 100$

EXAMPLE 11

100 Parts by weight of nickel oxide (NiO) having particle diameters ranging from 10 to 25 μm and 10 parts by weight of chromium oxide ($Cr_2O_3$) having particle diameters ranging from 8 to 30 μm were added to an aqueous solution consisting of 100 parts by weight of water, 2.25 parts by weight of gum arabic as a binder, 0.7 part by weight of sodium carboxymethyl cellulose as a dispersant, 0.1 part by weight of sodium hexametaphosphate as an antiflocculating agent, 0.001 part by weight of sodium lauryl sulfate as a surfactant and 0.1 part by weight of phenol as an antisepic agent. The resulting mixture were vigorously stirred to obtain a homogeneous suspension.

The thus obtained suspension was fed to the bottom of a continuous-type wet mill equipped with a pot having a capacity of 15 liters ("Pearl Mill" manufactured and sold by Drais Corporation, West Germany) at a feed rate of 70 kg/hr. The pot was filled with ceramic beads up to 70% of the total volume of the pot. The inside wall of the pot was equipped with a plurality of super hard pins. An agitator shaft having several discs was fixed at the central portion of the pot, and each disc was also provided with a plurality of super hard pins. By the rotation of the shaft, the suspension in the pot was mixed and the metal oxides particles dispersed were subjected to milling. The thus treated suspension was withdrawn from the top of the pot. The above treatment was repeated twice.

After milling, the particle diameters of each of NiO and $Cr_2O_3$ were reduced to be in the range of 0.3 μm or less.

In substantially the same manner as described in Example 1, the thus treated suspension was subjected to granulation, and the resulting granules were melt-sprayed on a wire screen as the substrate by plasma spraying, thereby to obtain an electrode.

The coating of the thus obtained electrode had a chromium component content of 8.1%. The analysis by X-ray diffractometry showed that the coating of the electrode contained nickel oxide (NiO) and metal nickel (Ni) and that no compound oxide of nickel-chromium was present in the coating of the electrode. The degree of oxidation [NiO/NiO+Ni (×100)] of the coating of the above-obtained coating was 90%.

Substantially the same procedures as in Example 1 were repeated to effect an electrolysis for evaluation of the performance of the, electrode except that use was made of the electrode as prepared above.

The results obtained are shown below in Table 5.

TABLE 5

| | At initial stage | After 5 months | After 10 months |
|---|---|---|---|
| Hydrogen overvoltage, mV (at 40 A/dm²) | 160 | 150 | 150 |
| Oxidation degree (%)* | 90 | 85 | 85 |

Note:
* $\frac{NiO}{NiO + Ni} \times 100$

EXAMPLE 12

An electrode was prepared in substantially the same manner as described in Example 1, except that 100 parts by weight of metal nickel (Ni) having particle diameters ranging from 0.3 to 0.7 μm were employed instead of 100 parts by weight of nickel oxide and that the amount of chromium oxide ($Cr_2O_3$) having particle diameters ranging from 0.5 to 3 μm was varied to 13 parts by weight.

The coating of the thus obtained electrode had a chromium component content of 9.5%. The analysis by X-ray diffractometry showed that the coating of the electrode contained nickel oxide (NiO) and metal nickel (Ni) and that no compound oxide of nickel-chromium was present in the coating of the electrode. The degree of oxidation [NiO/NiO+Ni (×100)] of the coating of the above-obtained coating was 60%.

Substantially the same procedures as in Example 1 were repeated to effect an electrolysis for evaluation of the performance of the electrode, except that use was made of the electrode as prepared above.

The results obtained are shown below in Table 6.

TABLE 6

| | At initial stage | After 5 months | After 10 months |
|---|---|---|---|
| Hydrogen overvoltage, mV (at 40 A/dm$^2$) | 170 | 170 | 170 |
| Oxidation degree (%)* | 60 | 50 | 50 |

Note:
* $\frac{NiO}{NiO + Ni} \times 100$

COMPARATIVE EXAMPLE 1

An electrode was prepared in substantially the same manner as described in Example 1, except that 100 parts by weight of nickel oxide (NiO) having particle diameters ranging from 0.2 to 2 μm were solely employed as the material for forming a coating.

The degree of oxidation [NiO/NiO+Ni (×100)] of the coating of the thus obtained electrode was 90%.

Substantially the same procedures as in Example 1 were repeated to effect an electrolysis for evaluation of the performance of the electrode, except that use was made of the electrode as prepared above.

The results obtained are shown below in Table 7.

TABLE 7

| | At initial stage | After 5 months | After 10 months |
|---|---|---|---|
| Hydrogen overvoltage, mV (at 40 A/dm$^2$) | 200 | 220 | 360 |
| Oxidation degree (%)* | 90 | 30 | 0 |

Note:
* $\frac{NiO}{NiO + Ni} \times 100$

The degree of oxidation of the coating of this electrode decreased with the lapse of time from the initial value of 90%, and became zero(0) 10 months after the initiation of the electrolysis. With the decrease of the oxidation degree, the hydrogen overvoltage of the electrode increased. It is recognized that the coating of this electrode lost almost all of its effect of lowering the hydrogen overvoltage during the 10-month operation of the electrolysis.

COMPARATIVE EXAMPLE 2

An electrode was prepared in substantially the same manner as described in Example 1, except that 100 parts by weight of powder cobalt oxide (CoO) having particle diameters ranging from 0.4 to 2 μm were solely used as the material for forming a coating.

The degree of oxidation [CoO/CoO+Co (×100)] of the coating of the thus obtained electrode was 100%.

Substantially the same procedures as in Example 1 were repeated to effect an electrolysis for evaluation of the performance of the electrode, except that use was made of the electrode as prepared above.

The results obtained are shown below in Table 8.

TABLE 8

| | At initial stage | After 5 months | After 10 months |
|---|---|---|---|
| Hydrogen overvoltage, mV (at 40 A/dm$^2$) | 210 | 230 | 350 |
| Oxidation degree (%) * | 100 | 30 | 0 |

Note:
* $\frac{CoO}{CoO + Co} \times 100$

COMPARATIVE EXAMPLE 3

An electrode was prepared in substantially the same manner as described in Example 1, except that 100 parts by weight of powder chromium oxide ($Cr_2O_3$) having particle diameters ranging from 0.5 to 3 μm were solely used as the material for preparing a coating.

The degree of oxidation [$Cr_2O_3/Cr_2O_3+Cr$ (×100)] of the coating of the thus obtained electrode which was determined by X-ray diffractometry in the same manner as in Example 1 was 95%.

Substantially the same procedures as in Example 1 were repeated to effect an electrolysis for evaluation of the perforemance of the electrode, except that use was made of the electrode as prepared above.

The results obtained are shown in Table 9.

TABLE 9

| | At initial stage | After 5 months | After 10 months |
|---|---|---|---|
| Hydrogen overvoltage, mV (at 40 A/dm$^2$) | 270 | 290 | 350 |
| Oxidation degree (%)* | 95 | 90 | 85 |

Note:
* $\frac{Cr_2O_3}{Cr_2O_3 + Cr} \times 100$

The hydrogen overvoltage of this electrode was high at the initial stage of the electrolysis, and increased with the lapse of time. The degree of oxidation decreased gradually, but the value itself was high throughout the 10-month operation of the electrolysis.

COMPARATIVE EXAMPLE 4

An electrode was prepared in substantially the same manner as described in Example 1, except that the amount of powder chromium oxide ($Cr_2O_3$) having particle diameters ranging from 0.5 to 3 μm was varied to 51 parts by weight. The coating of the thus obtained electrode had a chromium component content of 33%. The X-ray diffraction analysis showed the presence of a compound oxide of nickel-chromium ($NiCr_2O_4$) and chromium oxide ($Cr_2O_3$) in the coating of the thus obtained electrode. The degree of oxidation [NiO/NiO+Ni (×100)] of the coating of the electrode was 91%. The X-ray diffraction pattern of the coating of the obtained electrode is shown in FIG. 4.

Substantially the same procedures as in Example 1 were repeated to effect an electrolysis for evaluation of the performance of the electrode, except that use was made of the electrode as obtained above.

The results obtained are shown below in Table 10.

TABLE 10

| | At initial stage | After 5 months | After 10 months |
|---|---|---|---|
| Hydrogen overvoltage, mV (at 40 A/dm$^2$) | 270 | 290 | 290 |
| Oxidation degree (%)* | 91 | 80 | 80 |

Note:
* $\frac{NiO}{NiO + Ni} \times 100$

The degree of oxidation of the coating was high throughout the 10-month operation of the electrolysis. However, the hydrogen overvoltage of this electrode was high at the initial stage of the electrolysis.

COMPARATIVE EXAMPLE 5

Powder nickel oxide (NiO) having particle diameters ranging from 0.3 to 2 μm was dried using a dried air of 100° C. for two hours. In substantially the same manner as described in Example 1, the obtained nickel oxide powder was melt-sprayed on a wire screen as the substrate by plasma spraying, except that the feed rate of powder nickel oxide to plasma flame was 1 kg/hr, thereby to prepare an electrode.

The spraying yield of the nickel oxide was 10%, that is, NiO was coated on the substrate at a rate of 0.1 kg/hr. In this Example, clogging of the feed of the powder material with NiO was apt to occur during the course of feeding NiO to the plasma flame, and, hence, continuous operation of plasma spraying could not be effected smoothly. The plasma spraying was repeated 90 times with respect to each side of the electrode, thereby to obtain a 120 μm-thick coating on each side of the electrode.

Substantially the same procedures as in Example 1 were repeated to effect an electrolysis for evaluation of the performance of the electrode, except that use was made of the electrode as prepared above.

The results obtained are shown below in Table 11.

TABLE 11

| | At initial stage | After 5 months | After 10 months |
|---|---|---|---|
| Hydrogen overvoltage, mV (at 40 A/dm$^2$) | 220 | 200 | 350 |
| Oxidation degree (%)* | 90 | 50 | 0 |

Note:
* $\frac{Ni}{NiO + Ni} \times 100$

The degree of oxidation of the coating was decreased to 0% after the 10-month operation of electrolysis.

EXAMPLE 13

An electrode as prepared in substantially the same manner as described in Example 1, except that 14 parts by weight of powder chromium hydroxide [$Cr(OH)_3$] having particle diameters ranging from 0.5 to 3 μm was used instead of powder chromium oxide. The chromium component content of the coating of the thus obtained electrode was 9.5%. The degree of oxidation [NiO/NiO+Ni (×100)] of the coating of the electrode was 88%. The analysis by X-ray diffractometry showed that no compound oxide of nickel-chromium was present in the coating of the electrode.

Substantially the same procedures as in Example 1 were repeated to effect an electrolysis for evaluation of the performance of electrode, except that the electrode as prepared above was used.

The results obtained are shown below in Table 12.

TABLE 12

| | At initial stage | After 5 months | After 10 months |
|---|---|---|---|
| Hydrogen overvoltage, mV (at 40 A/dm$^2$) | 160 | 150 | 150 |
| Oxidation degree (%)* | 88 | 73 | 73 |

Note:
* $\frac{NiO}{NiO + Ni} \times 100$

EXAMPLE 14

An electrode was prepared in substantially the same manner as described in Example 1, except that 32 parts by weight of powder sodium chromium carbonate [$Na_2Cr(CO_3)_2.H_2O$] having particle diameters ranging from 0.3 to 3 μm was used instead of powder chromium oxide. The chromium component content of the coating of the thus obtained electrode was 8.8%. The degree of oxidation [NiO/NiO+Ni (×100)] of the coating of the electrode was 86%. The analysis by X-ray diffractometry showed that no compound oxide of nickel-chromium was present in the coating of the electrode.

Substantially the same procedures as in Example 1 were repeated to effect an electrolysis for evaluation of the performance of electrode, except that the electrode as prepared above was used.

The results obtained are shown below in Table 13.

TABLE 13

| | At initial stage | After 5 months | After 10 months |
|---|---|---|---|
| Hydrogen overvoltage, mV (at 40 A/dm$^2$) | 160 | 150 | 150 |
| Oxidation degree (%)* | 86 | 71 | 71 |

Note:
* $\frac{NiO}{NiO + Ni} \times 100$

EXAMPLE 15

An electrode was prepared in substantially the same manner as described in Example 1, except that 26 parts by weight of powder chromium oxalate [$Cr_2(C_2O_4)_3.H_2O$] having particle diameters ranging from 0.2 to 2.5 μm was used instead of powder chromium oxide. The chromium component content of the coating of the thus obtained electrode was 9.2%. The degree of oxidation [NiO/NiO+Ni(×100)] of the coating of the electrode was 88%. The analysis by X-ray diffractometry showed that no compound oxide of nickel-chromium was present in the coating of the electrode.

Substantially the same procedures as in Example 1 were repeated to effect an electrolysis for evaluation of the performance of electrode, except that the electrode as prepared above was used.

The results obtained are shown below in Table 14.

TABLE 14

| | At initial stage | After 5 months | After 10 months |
|---|---|---|---|
| Hydrogen overvoltage, mV (at 40 A/dm$^2$) | 160 | 150 | 150 |
| Oxidation degree (%)* | 88 | 75 | 75 |

Note:
* $\frac{NiO}{NiO + Ni} \times 100$

What is claimed is:

1. A hydrogen-evolution electrode comprising an electrically conductive substrate having thereon a coating comprising a chromium component and an oxide of at least one metal selected from the group consisting of nickel and cobalt produced by a method comprising:

(1) mixing a finely divided powder of at least one member selected from the first group consisting of nickel, cobalt, nickel oxide, cobalt oxide, nickel hydroxide, cobalt hydroxide, organic acid salts of nickel, organic acid salts of cobalt, inorganic acid salts of nickel and inorganic acid salts of cobalt with a finely divided powder of at least one member selected from the second group consisting of chromium, chromium oxide, chromium hydroxide, organic acid salts of chromium and inorganic acid salts of chromium in such an amount ratio as gives a mixture of the powders containing said chromium component in a proportion, in terms of atomic percentage, of 0.5 to 20%, said atomic percentage being defined by the following formula $$\frac{A_{Cr}}{A_T} \times 100 \quad (1)$$

wherein $A_{Cr}$ represents the number of chromium atoms in the coating and $A_T$ represents the total number of atoms of chromium and said at least one metal in the coating; and (2) applying the resulting mixture onto an electrically conductive substrate by melt spraying thereby to obtain a hydrogen-evolution electrode having thereon a coating containing an oxide of at least one metal selected from the group consisting of nickel and cobalt in an amount, in terms of degree of oxidation, of 20 to less than 100%, said degree of oxidation being defined by the formula $$\frac{H_1}{H_1 + H_0} \times 100$$

where $H_O$ represents the height of a peak of the highest intensity X-ray diffraction line of a metal selected from the group consisting of nickel and cobalt when the coating is analyzed by X-ray diffractometry, or represents the arithmetic mean of the heights of peaks of the highest intensity X-ray diffraction lines respectively of nickel and cobalt in case the coating contains both nickel and cobalt; $H_1$ represents the height of a peak of the highest intensity X-ray diffraction line of an oxide of said metal, or represents the arithmetic mean of the heights of peaks of the highest intensity X-ray diffraction lines respectively of nickel oxide and cobalt oxide in case the coating contains both nickel oxide and cobalt oxide.

2. An electrode according to claim 1, wherein said electrically conductive substrate is made of an anticorrosive material selected from nickel, a nickel alloy and an austenite type stainless steel.

3. An electrode according to claim 1, wherein with respect to said first group use is made of at least one member selected from the group consisting of nickel, nickel oxide, nickel hydroxide, organic acid salts of nickel and inorganic acid salts of nickel.

4. An electrode according to claim 1, wherein in step (1) a finely divided power of nickel oxide is mixed with a finely divided powder of chromium oxide.

5. An electrode according to claim 1, wherein in step (1) said mixing is further made with a finely divided power of at least one member selected from the third group consisting of molybdenum, zinc, tin, tungsten, aluminum and silicon and oxides thereof.

6. An electrode according to claim 1, wherein between steps (1) and (2), said mixture of the powders is subjected to granulation to obtain a mixture in the form of granules.

7. An electrode according to claim 6, wherein in step (1) use is made of powders having particle size of 5 μm or less.

* * * * *